United States Patent [19]

Furukawa

[11] Patent Number: 4,717,364

[45] Date of Patent: Jan. 5, 1988

[54] VOICE CONTROLLED TOY

[75] Inventor: Masami Furukawa, Tokyo, Japan

[73] Assignee: Tomy Kogyo Inc., Tokyo, Japan

[21] Appl. No.: 647,144

[22] Filed: Sep. 4, 1984

[30] Foreign Application Priority Data

Sep. 5, 1983 [JP] Japan ..... 58-162008

[51] Int. Cl.[4] ..... A63H 11/10

[52] U.S. Cl. ..... 446/175; 446/280; 446/354; 367/198; 74/789; 74/665 GA; 74/674; 74/353; 381/110

[58] Field of Search ..... 446/175, 454, 456, 443, 446/436, 279, 354, 289, 290, 352, 353, 280; 340/825.72; 381/110; 364/513.5, 513; 367/198, 197; 74/789, 665 GA, 674, 353

[56] References Cited

U.S. PATENT DOCUMENTS

| | | | |
|---|---|---|---|
| 2,108,586 | 2/1938 | Hutchings | 74/353 |
| 2,974,441 | 3/1961 | Denner | 446/175 |
| 3,199,249 | 8/1965 | Carver et al. | 446/290 |
| 3,686,974 | 8/1972 | Little, Jr. | 74/665 GA |
| 4,224,762 | 9/1980 | McCaslin | 340/825.72 X |
| 4,389,109 | 6/1983 | Taniguchi et al. | 367/198 X |

*Primary Examiner*—Mickey Yu
*Attorney, Agent, or Firm*—Herb Boswell

[57] ABSTRACT

A voice actuated toy robot receives commands via a radio transmitter and receiver, and in response to receipt of these commands propogates a signal through a CPU. Initially the toy is programmed by storing records of commands in a memory which is associated with the CPU. Upon further receipt of identical commands, the CPU scans the memory and upon finding a match between a record in the memory and a new command, the CPU activates a switch associated with the record in the memory so as to set the switch. A mechanical interogator is capable of cycicly interogating a plurality of switches each of which corresponds to one of the records in the memory. Upon interogation of the switches, if it is determined a signal is present at one of the switches, the interogator ceases interogation and a mechanism is set so as to propogate motion from a motor to an appendage driving wheel or the like of the robot to produce an output in response to the audio command which was received.

18 Claims, 23 Drawing Figures

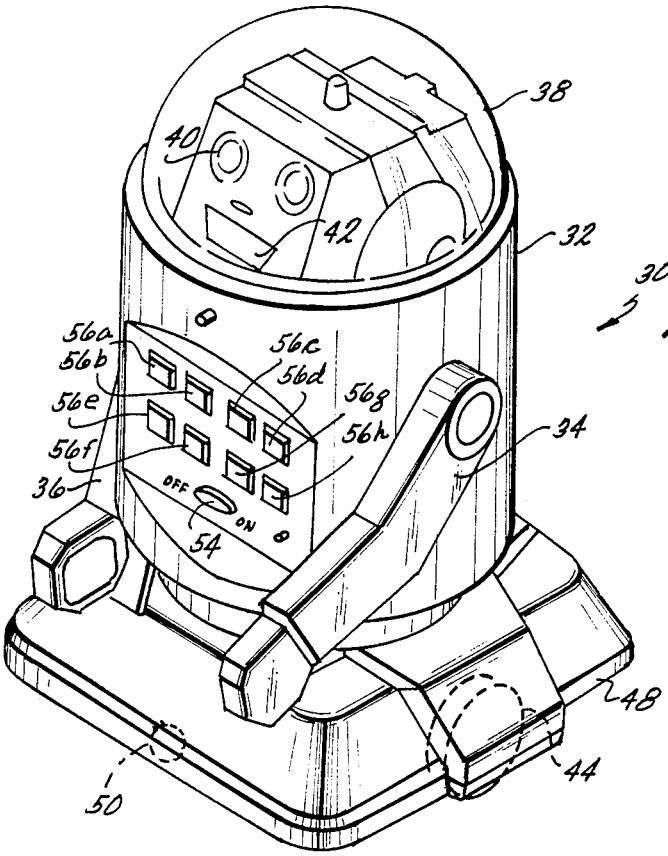
Fig. 1
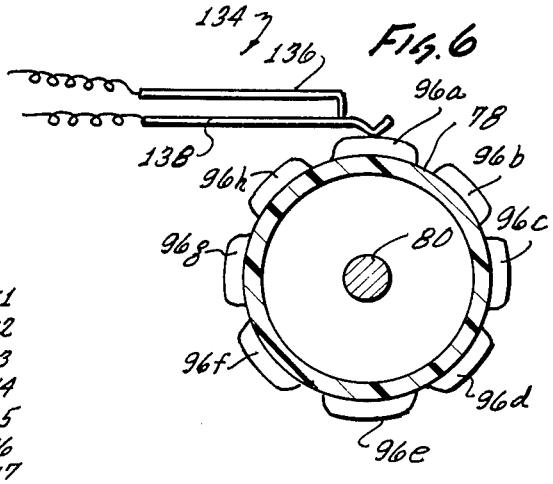
Fig. 6
Fig. 7
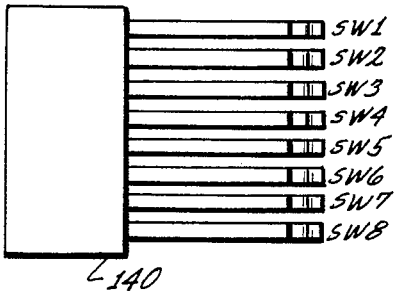

308
296
298
284
PS1
PS2
300
PS5
PS3
82
PS6
PS4
234
PS7
PS8
46
176
178
50
154
180
52
156
84
150
50
160
44
48

46
182
180
176
178
174
208
204
166
162
200
102
214
168
164
190
114
228
188
144
212
96a
96b
96c
96d
78
80
86
120
118
96e
96f
146
186
182
180
178
184
148
152
150
154
156
158
160
44

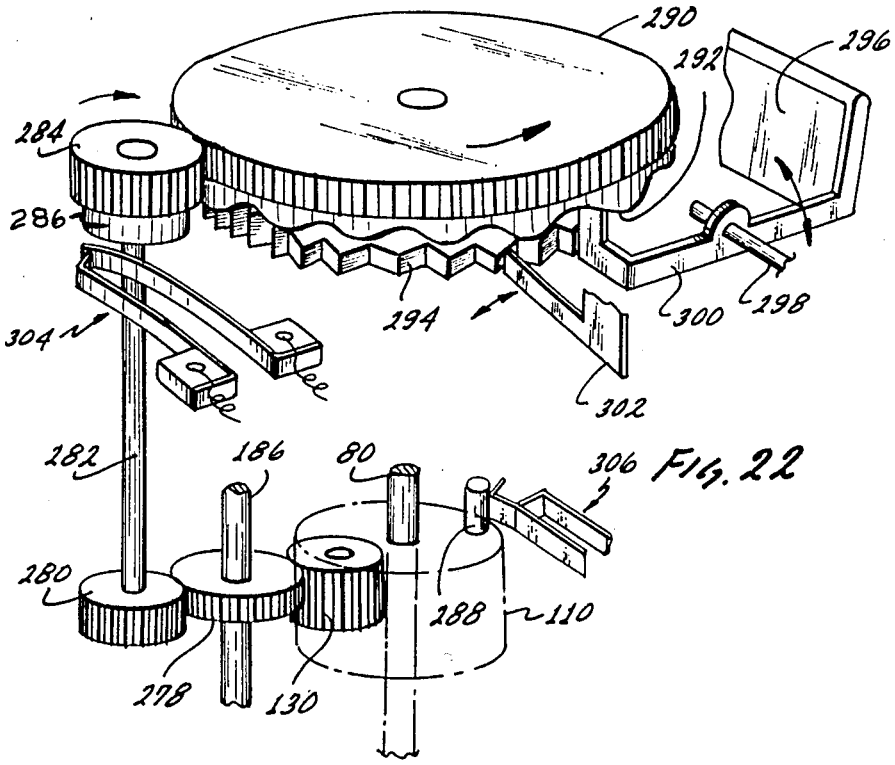
Fig. 22
Fig. 23
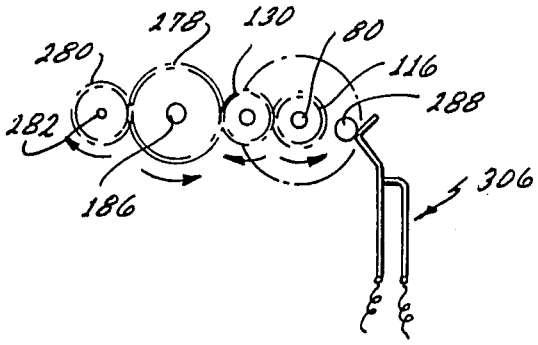

VOICE CONTROLLED TOY

BACKGROUND OF THE INVENTION

This invention is directed to a voice controlled toy which makes a plurality of movements each of which is governed by an appropriate voice command uttered by the operator of the toy. The invention utilizes a radio transmitter and receiver for transfer of the voice commands from the operation to the toy. The toy further includes a CPU and an associated memory for comparing the voice command with stored records of voice commands. Electrical signals outputed by the CPU are fed to a plurality of switches which are interrogated one at a time by a drive mechanism in the toy. In response to recognition of a particular command, the toy executes a particular motion.

A variety of remote control toys are known. Earlier remote toys were in fact not true remote control in that they utilized a tether, coaxial cable or the like, to connect the operator of the toy with the toy. With refinement and miniturization of radio transmitters and receivers, true remote control toys were developed. These toys, however, were very limited in their action and for the most part executed only a single action or movement in response to receipt of radio signals.

Further sophistication of remote control toys utilized broadcasting at two different band frequencies such that two motions or movements could be executed. A variety of these so called "dual channel" toys are known. As for instance radio controlled race cars and the like are known which utilize a first channel to control a steering motion and a second channel to control an acceleration motion. Normally the operator inputs a signal to the transmitter by operation of a joystick or the like.

More recently remote control toys have been developed which respond to audio commands. These, however, are quite limited. They essentially respond to the presence of or the absence of any audio command, i.e. on and off. The source, content, or other individual characteristics of the audio command are completely ignored in these toys. It matters not what the audio command is except whether it is present or it is absent.

With the widespread poliferation of micro computers, CPUs (i.e. central processing units) have been developed which utilize either external or internal memory to store the pattern of a particular audio signal. U.S. Pat. Nos. 4,181,821 and 4,348,550 give brief histories of developments in this area.

For the most part the research directed to voice recognition devices is associated with highly sophisticated and expensive systems. It goes without saying that in order for a toy to incorporate and utilize any type of technology, the use of this technology in the toy must be extremely simple and economical. Because of the practicalities of the marketplace it is extremely difficult to incorporate new technologies into toys because of the complexities and the cost associated with those technologies. In order for the toy to become an economical reality, its mechanism must be simple, inexpensive, and capable of mass production. Further, the ultimate toy must not be "fragile" because the users of the toy, children subject their toys to rigorous use and abuse.

Because of the above considerations, it is simply economically unpractical to burden a toy with multiple motors each which only drives a single function. Further, it is impractical, because of the user of the toy, to burden the toy with extremely complicated controls beyond the intellectual development of the young user of the toy. Additionally, any technology incorporated into the toy must be entertaining in order to maintain the interest of the child yet it also can not be unduly complicated which would inhibit enjoyment of the toy by the child.

BRIEF DESCRIPTION OF THE INVENTION

In view of the above, it is a broad object of this invention to provide a toy which utilizes an extremely simple switching means to provide a plurality of outputs in response to inputed control signals. It is a further object of this invention to provide a toy which utilizes a voice recognition system for these inputed signals. Additionally, it is the object of this invention to provide a toy which because of its engineering principles, is capable of exhibiting multiple outputs utilizing a minimum of control units to control these multiple outputs. Also, it is the object of this invention to provide a toy which is entertaining and enjoyable to a child yet is educational in nature.

These and other objects as become evident in the remainder of this specification are achieved in a voice actuated toy which comprises in an electronic means for receiving audio signals and storing records of said audio signals, said electronic means further capable of comparing an inputed audio signal with each of its previously stored audio signals, said electronic means outputing a particular output signal in response to receipt of an input audio signal which matches one of said stored records of audio signals; a plurality of switches connected to said electronic means, the number of said switches equal to the number of said stored records of said audio signals, each of said switches including an output terminal; a drive means operatively associated with said switches, said drive means having a plurality of output members each of which is capable of executing a predetermined movement, said drive means output members executing said movements in response to said output signals of said electronic means; said drive means further including switch interaction means for interacting with said plurality of switches one at a time, each of said respective output signals from said electronic means propogated to said drive means only when the respective switch associated with said respective signal is activated by said switch interaction means.

Further, these objects are achieved in a robot which comprises a housing, a plurality of movable means movable mounted on said housing for movement relative to said housing; a motor means mounted on said housing, said motor producing a first output and a second output, one of said first and second outputs comprising a clockwise output and the other of said first and second outputs comprising a counterclockwise output; connector means located on said housing, said connector means operatively associated with said motor so as to receive both of said first and second outputs, said connector means further operatively associated with each of said plurality of movable means, said connector means for transmitting said first output of said motor independently to each of said movable means so as to move said movable means relative to said housing; said connector means including selector means, said selector means rotatably mounted on said housing, said selector means rotating in response to said second output and said selector means remaining stationary in one of a plurality of positions in response to said first output, in each of said positions said selector means transfering said first output to one of said plurality of movable means to move said respective movable means with respect to said housing.

In the illustrative embodiment of the invention, the electronic means includes a CPU and associated memory. Audio signals received by the CPU are stored as records in the memory and upon receipt of further audio signals, the further signals are compared to those in memory. Upon receipt of an audio signal which compares to one for which a record is in memory, the CPU outputs an electronic signal to a switch which is associated with the memory record.

In the illustrative embodiment, the selector means includes a rotating member which is positioned in association with the switches connected to the electronic means. The rotating member is capable of selecting the switches one at a time so as to interogate the switches. In the illustrative embodiment, during interogation of the switches, if the CPU had sent a "high" signal to one of the switches, upon closing of this switch, propogation of this signal to a motor causes reversal of the direction of rotation of the motor. The motor is connected to the rotating member so as to reverse the direction of rotation of the member. The member, however, is capable of rotating only in one direction and upon reversal of direction of the motor, the member is fixed in position maintaining the particular switch which is "high" in a closed position which in turn maintains the motor rotating in its present direction of rotation. Upon receipt of a new "high" signal at a different switch, the old switch goes "low" which again reverses the motor. This starts rotation of the rotating member and interogation of the switches starts again.

In the illustrative embodiment, gear trains are utilized as a portion of the connector means to propogate motions from the motor to the appropriate movable means of the invention. In the illustrative embodiment, the movable means comprise rotating drive wheels, movable appendages, and other movable members attached to the toy robot of the illustrative embodiment. The rotating member further includes gear selector means located thereon which select the appropriate gear train for propagation of motion from the motor to the movable means.

BRIEF DESCRIPTION OF THE DRAWINGS

This invention will be better understood when taken in conjunction with the drawings wherein:

FIG. 1 is an isometric view showing the outside of a toy which embodies the principles of this invention;

FIG. 6 is an end elevational view in section about the line 6—6 of FIG. 5;

FIG. 7 is a top plan view of a bank of switches one of which is seen in FIG. 6;

FIG. 22 is an isometric view of certain of the components which are located near the upper portion of the device as seen in FIG. 2; and FIG. 23 is a top plan view of a gear train which is associated with the top of the component which is shown in FIG. 5.

Figure 2:
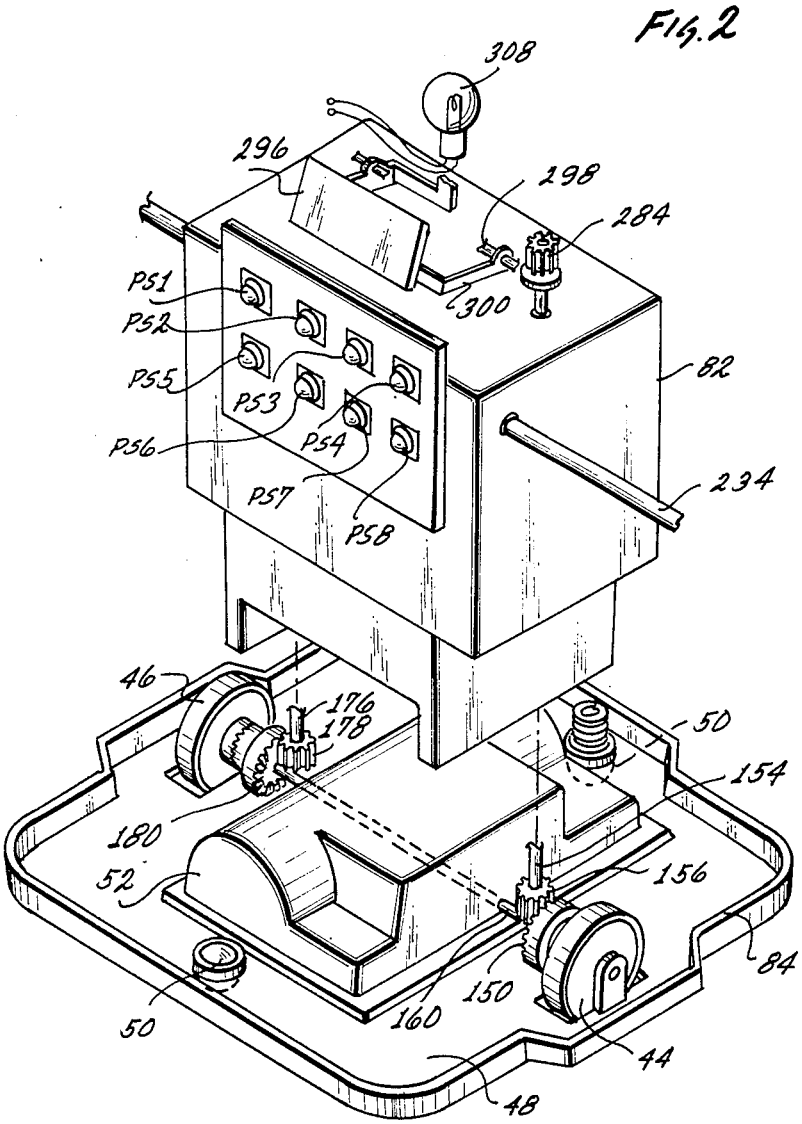
FIG. 2 is an isometric view showing the same toy with its outside cover housing removed.

This invention utilizes certain principles and/or concepts as are set forth in the claims appended to this specification. Those skilled in the toy arts associated with electronics and robotics will realize that the principles and concepts are set forth in the claims are capable of being expressed in a variety of embodiments which may differ from the exact embodiment utilized for illustrative purposes herein. For this reason this invention is not to be construed as being limited solely to the illustrative embodiment but should only be construed in view of the claims.

DETAILED DESCRIPTION OF THE INVENTION

In FIG. 1 there is shown an illustrated embodiment of this invention comprising a toy robot 30. The toy robot 30 has a central body 32 to which are attached left arm 34 and right arm 36. On the top central portion of the robot is a clear plastic hemispheric cover 38 through which can be seen two eye-like openings collectively identified by the numeral 40 and a mouth identified by the numeral 42. As better seen in other figures, such as in FIG. 2, the toy robot 30 includes a left drive wheel 44 and a right drive wheel 46.

The body 32 is mounted to a bottom plate 48 having openings through which the drive wheels 44 and 46 extend. The bottom plate 48 further includes a front and rear ball bearing both collectively identified by the numeral 50 which together with the wheels 44 and 46 support the toy and allow it to roll over a surface.

The bottom late 48 also includes a battery case 52 in which appropriate batteries are inserted to supply power to the toy robot 30.

On the front of the toy robot 30 is an off and on switch 54 and a panel of eight push-buttons collectively identified by the numeral 56 in FIGS. 1 and 2. The push-buttons 56 are utilized during input and storage of certain voice commands to the robot 30 for control of the same.

The robot 30 includes an internal memory and drive unit which will be explained here after, however, prior to explaining these a brief description of the operation of the toy robot 30 will lend to a better understanding of the workings of the internal components.

Figure 3:
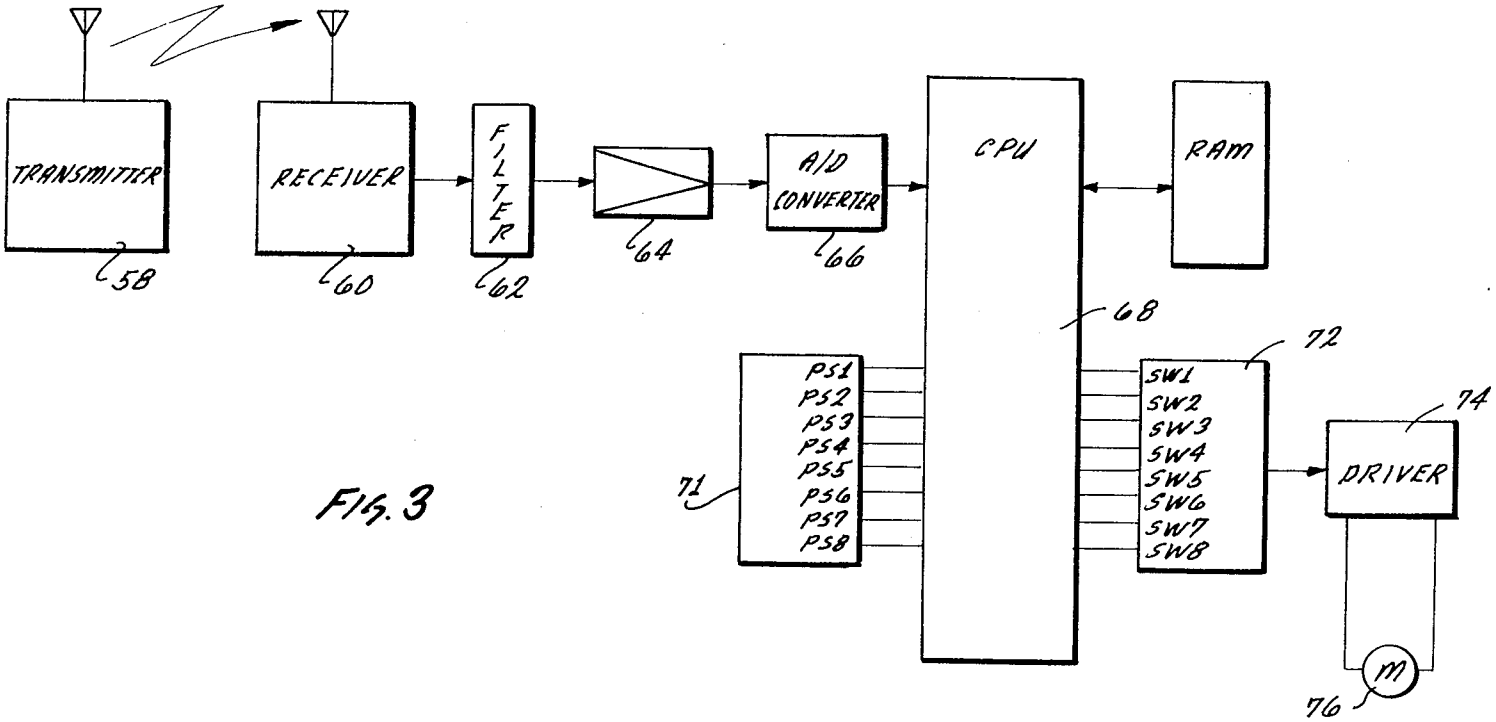
FIG. 3 is a block diagram of certain electronic components of the toy.

The toy robot 30 is turned on utilizing the off and on switch 54. A hand held transmitter 58 shown in FIG. 3 is utilized in conjunction with the toy robot 30. After activating the toy robot 30 with the off and on switch 54, the buttons 56 are sequentially pressed in conjunction with the uttering of audible sounds into the transmitter 58 to program the toy robot 30. As for instance, button 56 A governs the "stop" function of the toy robot 30. To program the toy robot 30 to stop the button 56 A is depressed inwardly and an appropriate command such as stop, halt, or the like, is spoken into the transmitter 58. Once this command is given to the toy robot 30, the next button 56 B is depressed and an appropriate command is given to the toy robot 30 which will activate its eyes 40 and mouth 42. Such a command may be a hello or other similar greeting.

Next, a command is programmed using button 56 C to tell the toy robot to move forward. An appropriate command would be forward, advance or the like. In a like manner, the buttons 56 D, 56 E, 56 F, 56 G and 56 H are programmed for commands to indicate the toy robot 30 to move backwards, to turn to the left, to turn to the right, and to move its arms 34 and 36 upwardly or downwardly respectively. Once programmed the toy robot 30 is ready to be totally controlled remotely with the transmitter 58.

By speaking the exact same command into the transmitter 58, which corresponds with the command the robot was programmed with when the respective button 56 was depressed, the toy robot 30 will respond by executing the appropriate command. As for instance, if the operator of the toy robot 30 wants the robot 30 to move forward and the word "forward" was utilized to program the button 56 C, when the word forward is repeated and the toy robot 30 will then proceed to move forward. By repeating each of the audible commands which were utilized to program to toy robot 30, the toy robot 30 will execute these commands in response to the vocalization of the same into the transmitter 58.

In FIG. 3 a blocked diagram shows the operation of the electronic components of the invention. The transmitter 58, a standard radio frequency transmitter, emits a radio signal in response to an audio input. This signal is received by receiver 60 which is carried on board the toy robot 30. The receiver 60 is also a standard radio receiver. The signal received by the receiver 60 is fed through a filter 62 and an amplifier 64 in a conventional manner. From the amplifier 64 the signal is then fed to an A/D converter 66 which digitizes the signal. The signal then inputed into a CPU 68. Suitable as the CPU would be a MN15541NTR, manufactured by the Matsushita Corp., Japan.

Associated with the CPU is a memory unit 70. Suitable for the memory 70 is a RAM such as a MN2114-3 also available from the Matsushita Corporation, Japan. Binary records of audio command as received by the receiver 60 and processed by the filter 62, the amplifier 64, the A/D converter 66 and CPU 68 are stored in the memory 70.

Also associated with the CPU are the pressure switches PS 1 to PS 8 shown by block 71 in FIG. 3. Further, a switch bank 72 is associated with the CPU 68. The switch bank 72 is connected to a driver 74 which controls a motor 76. The drive 74 is capable of reversing the motor 76.

Figure 4:
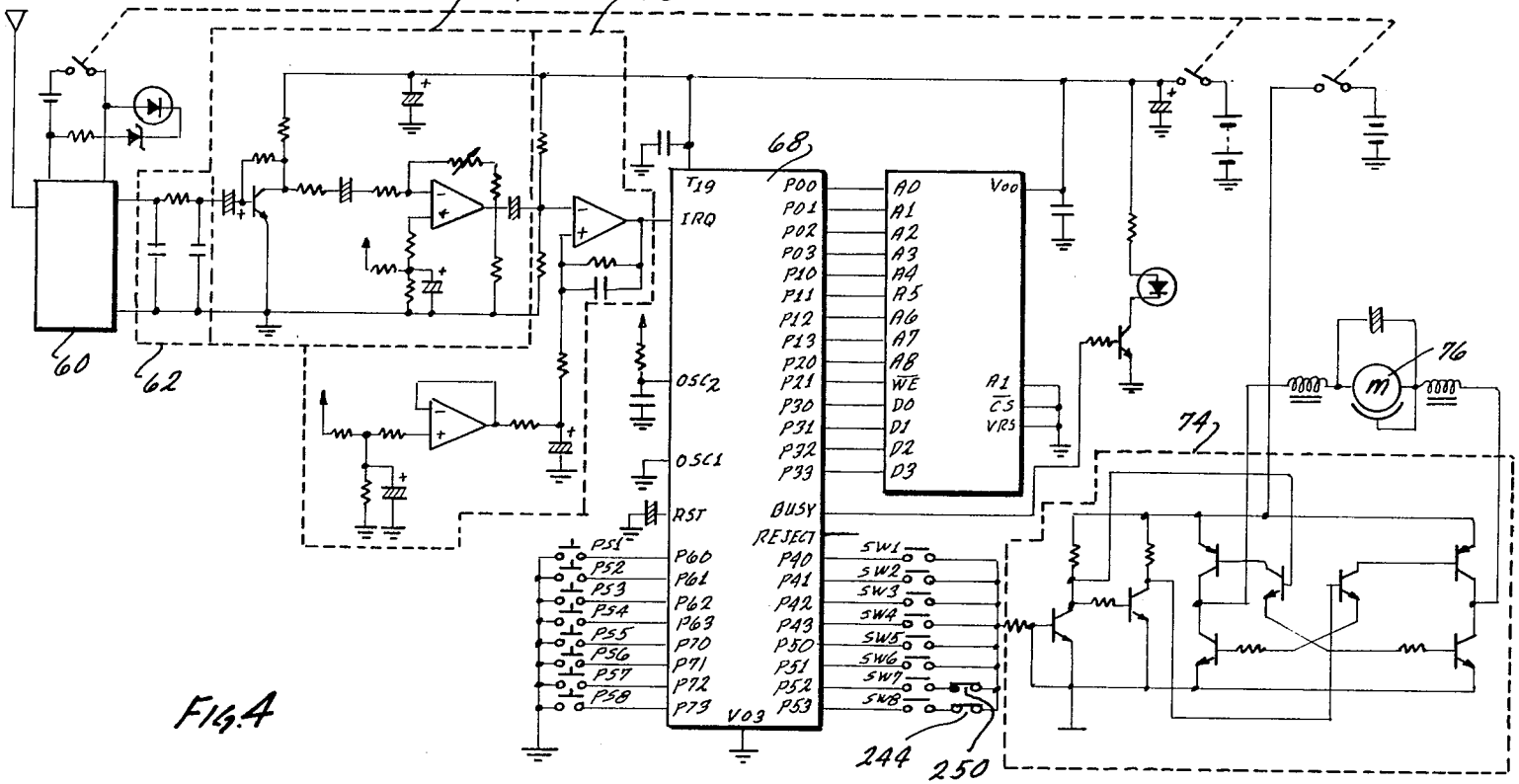
FIG. 4 is an electrical schematic of the components shown in FIG. 3.

FIG. 4 is an electrical schematic of the components seen in FIG. 3. The pressure switches PS 1, PS 2, PS 3, PS 4, PS 5, PS 6, PS 7 and PS 8 shown in FIG. 4 are mechanically activated by the push-buttons 56 A through H of FIG. 1. Thus if button 56 A is depressed pressure switch PS 1 is activated if button 56 B is depressed pressure switch PS 2 is activated, etc etc for the remainder of the respective button 56 C through H and pressure switches PS 3 through PS 8. The switch bank 72 includes switches SW 1, SW 2, SW 3, SW 4, SW 5, SW 6, SW 7 and SW 8. Each of these is connected to the driver 74. However, switches SW 7 and SW 8 do not directly connect to the driver 74, but each of them include a further switch connected in series with it and the driver 74. There are the same number of switches SW 1 to SW 8 as there are pressure switches PS 1 to PS 8.

Individual commands are inputed through the CPU 68 for storage as binary records in the memory 70. The commands are inputed as noted above by depressing one of the buttons 56 A through H which, in turn, activates the pressure switches PS 1 through PS 8 respectively. Suitable for the commands would be the words stop, hello, forward, back, left, right, up and down. Each time these commands are again received by the receiver 60 and are processed by the filter 62, the amplifier 64 and the A/D converter 66 and fed to the CPU 68, they are then compared to the binary record of the original signals which are stored in the memory 70. If a match is found between the digitized command and one of the binary records, the one switch SW 1 to SW 8 which is associated with the respective record, is activated.

When a signal is recognized by matching it to one of the binary records images stored in the memory 70, the appropriate switch SW 1 through SW 8 corresponding to the record of the input of the signal PS 1 through PS 8 respectively goes high. The other of the switches SW 1 to SW 8 remain low. As hereinafter explained, the switches SW 1 through SW 8 are cyclicly interogated. During this sequential interogation, if it is found that one of the switches, SW 1 through SW 8, is in the high state, interogation ceases and certain components within the interior of the toy robot 30, as are hereinafter explained, are fixed in position such that a mechanical connection is made between the motor 76 and a movable component of the robot 30 which produces an action, such as movement of the drive wheels 44 or 46, or the arms 34 or 36, or the eyes 40 and the mouth 42 or the like. Normally a word which is associated with the function of a particular button 56 would be used as the command word for that function. Thus in the example above the word "forward" was associated with the "forward" function controlled by the button 56 C and the pressure switch PS 3. Any word however could have been programmed into the "forward" function, as for instance the word "backward". If the word "backward" was programmed into the "forward" function by speaking the word "backward" when the button 56 C was depressed, when the word "backward" was repeated, the toy robot 30 would execute the "forward" function associated with the pressure switch PS 3. The function associated with each of the pressure switches is predetermined irrespective of what particular word might be programmed into the record associated with the particular function.

Figure 5:
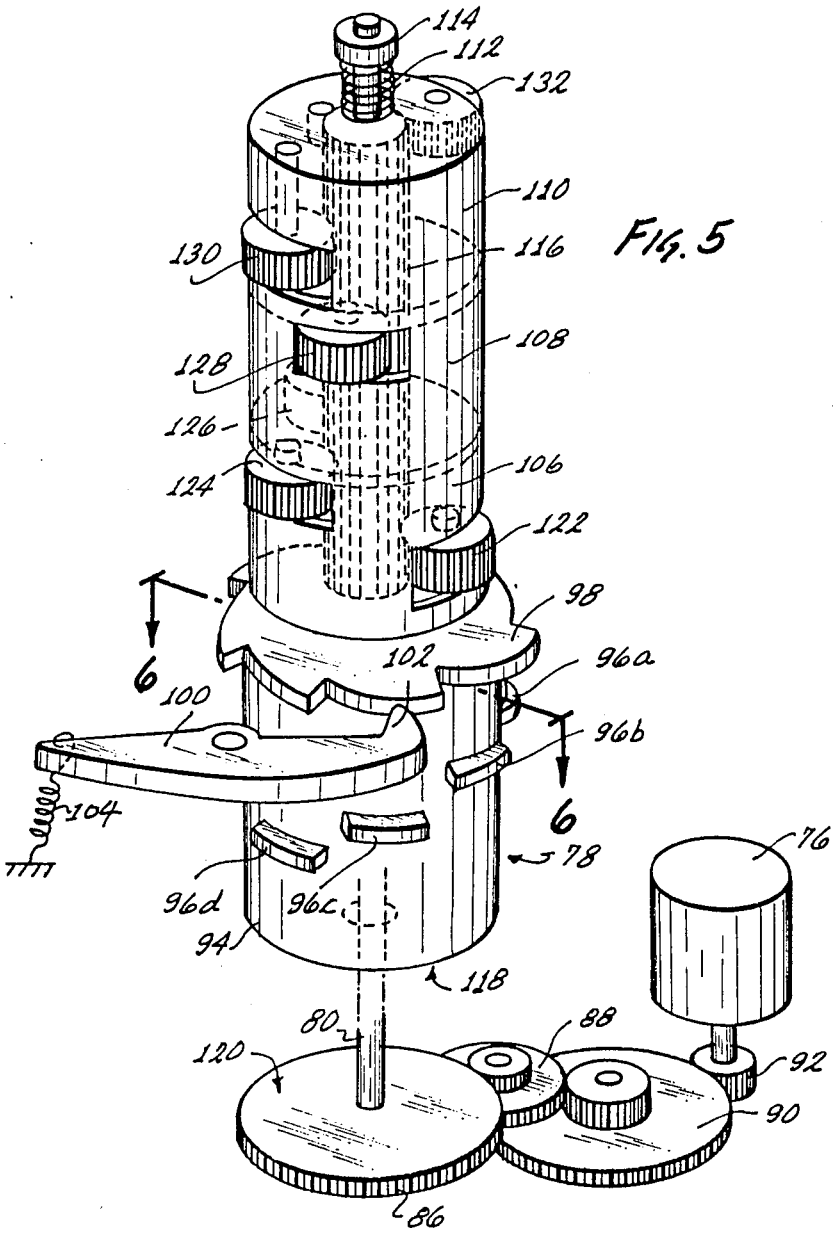
FIG. 5 is an isometric view showing a major control component of the invention.
Figure 8:
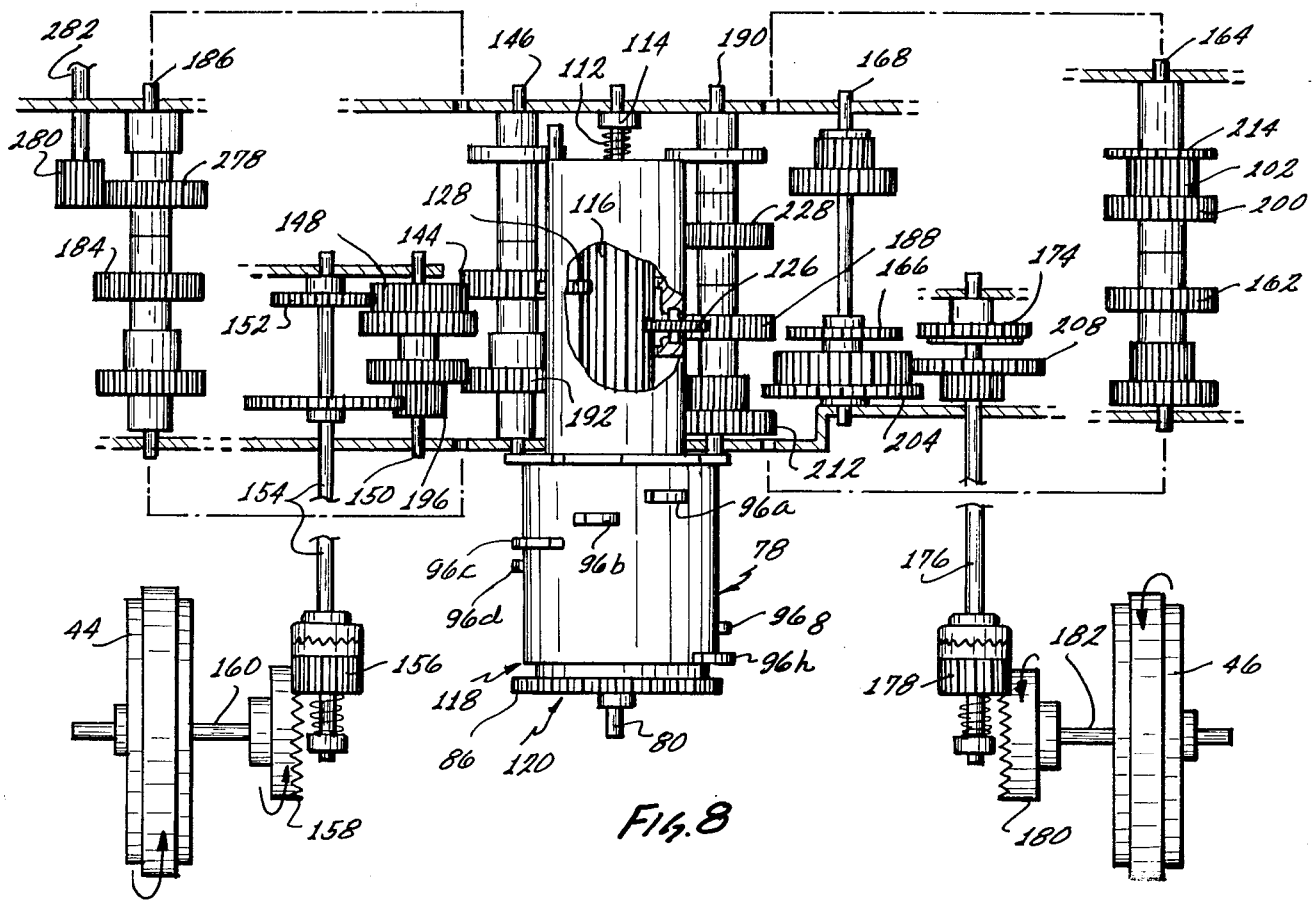
FIG. 8 is a rear elevational view with certain components exploded away for clarity of underlying components.
Figure 9:
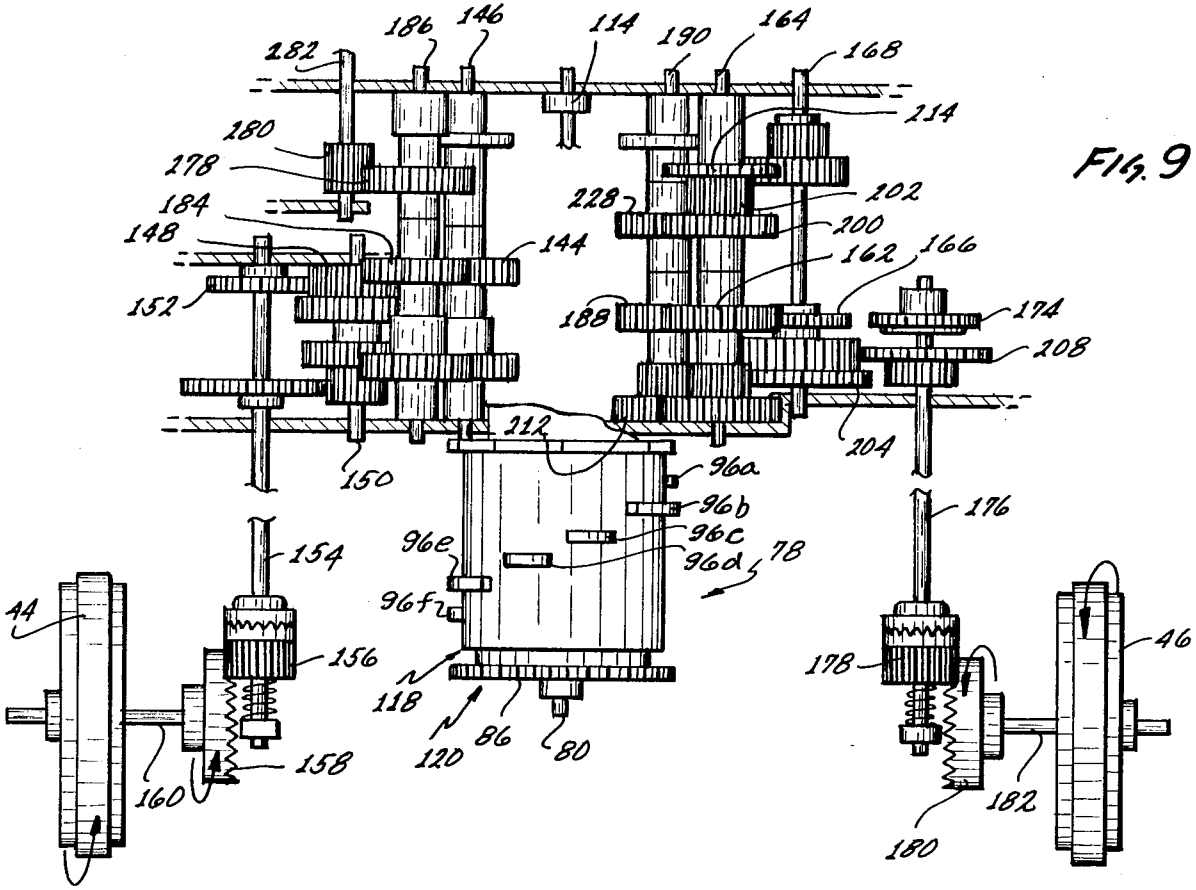
FIG. 9 is a rear elevational view similar to FIG. 8 except portions of a central component have been removed and no parts are exploded as they were in FIG. 8.

During the interogation of the switches SW 1 through SW 8, the motor 76 rotates in a first direction, counterclockwise as seen in FIG. 5. During the interogation, when the switch SW 1 through SW 8 which is high is then selected, a signal is propogated to the drive 74 which reverses the direction of rotation of the motor 76 such that it rotates clockwise and at the same time locks a mechanical component as herein after explained in a fixed position which does two things. The first of these is it locks the "interogator" onto the particular switch which is in the high state and makes a mechanical connection between the motor 76 and a particular output function of the robot 30 to activate that output function.

As noted above the output function is either a stop function, a movement of the eyes 40 and the mouth 42, simultaneous rotation in a forward direction of both of the left wheel and right wheel 44 and 46, simultaneous rotation of the wheels 44 and 46 in a reverse direction, opposite direction of the wheels 44 and 46 to first go left because of rotation in one direction, and go right because of rotation in the other direction, movement of the arms 34 and 36 upwardly or movement of the arms 34 and 36 downwardly.

Having interogated the mechanical equivalent of the switches SW 1 through SW 8 and having locked onto the particular switch which is in the high state, the motor 76 reverses directions to lock the interogator in a fixed position with the high switch. This causes the robot 30 to output continuously the particular motion or the like associated with that switch until a new audio signal is received. When the new audio signal is received, the receiver 60 now compares it to the stored records in the memory 70 and a different switch, SW 1 through SW 8, goes high. When this happens, because the interogator is still positioned on the previous switch which is now low, the signal to the driver 74 goes low which causes the motor 76 to reverse direction to reinstitute interogation of the switches SW 1 through SW 8 until the appropriate high switch is found at which time the robot 30 outputs the particular action which is associated with the respective switch which is now in the high state.

In FIG. 5 certain components are shown which serve as the switch interogator and mechanical selector for propogating rotational motion of the motor 76 to the movable components of the robot toy 30 such as the arms 34, 36, the drive wheels 44 and 46, and components associated with the eyes 40 and mouth 42. A central rotating member 78 serves as the heart of the interogator and selecting components. The rotating member 78 has a central shaft 80 which is appropriately journaled within the internal housing 82 shown in FIG. 2.

For brevity of this specification, the shaft 80 as well as other shafts and axels as hereinafter described are appropriately journaled in bearing surfaces not separately numbered and described which are located in the internal housing 82. The internal housing 82 also serves to support the motor 76 and other appropriate internal components.

The internal housing 82 in itself is appropriately supported on the bottom plate 48. The outside body 32 is attached to the bottom plate 48 by locating it within a rim 84. As such the outside body 32 completely surrounds the internal housing 82.

Fixedly attached to the shaft 80 is a large spur gear 86 which meshes with gear 88 which in turn meshes with gear 90. The gear 90 meshes with a pinon 92 which is attached to the output shaft of the motor 76. Motion from the motor 76 is therefore propogated through the gear train 92, 90, 88 and 86 to the shaft 80.

The rotating member 78 includes a drum portion 94 which has eight switch engagement members collectively identified by the numeral 96 placed in a spaced array around the outside circumferential surface of the drum 94. Each of the switch engagement members is spaced 45 degrees from its adjacent neighbors.

The rotating member 78 further includes a ratchet gear 98 which has 8 individual teeth located thereon. The ratchet gear 98 is fixed to the drum 94 so as to rotate in conjunction with the drum 94. Further, the teeth in the ratchet gear 98 are located in conjunction with the switch engagement members 96 on the drum 94. Located adjacent to the ratchet gear 98 is a pawl 100 having a detent 102 on one of its ends. The pawl 100 is pivoted to the internal housing 82 and includes a spring 104 on the end opposite of the detent 102. The spring connects between the pawl 100 and the internal housing 82 and biases the detent 102 toward the teeth on the ratchet wheel 98.

Because of the presence of the pawl 100 and the interaction of its detent 102 with the teeth of the ratchet gear 98, as seen in FIG. 5, the rotating member 78 is free to turn clockwise. However it is prevented from turning counterclockwise because the detent 102 locks with the teeth on the ratchet gear 98. The significance of this will be evident later.

Located next to the ratchet gear 98 on the rotating member 78 is a first gear holding member 106 and next to it a second gear holding 108 and next to the second gear holding member 108 is a third gear holding member 110. The gear holding members 106, 108, and 110 are connected together so as to rotate as a unit with the first gear holding member 106 connecting to the ratchet gear 98. Because of this the totally of the drum 94, the ratchet gear 98 and the gear holding members 106, 108 and 110 rotate together as an integral body. A compression spring 112 fits over the upper end of the shaft 80 and is held in place by a bushing 114 which is fixed to the shaft 80.

Internal of the gear holding members 106, 108, and 110 is an elongated pinon or sun gear 116. The pinon 116 is fixed to the shaft 80 and thus rotates with conjunction with the shaft 80 and the spur gear 86. The rotating member 78 and all its component parts are not fixed to the shaft 80 and thus rotates independent to the shaft 80 and the pinon 116 and spur gear 86. The spring 112, however, biases the rotating member 78 down toward the spur gear 86 to form a clutch between the lower edge 118 of the drum 94 and the upper surface 120 of the spur gear 86. If nothing impedes its movement the totality of the rotating member 78 will rotate in conjunction with the spur gear 86. However, if anything as for instance the pawl 100 impedes rotation of the rotating member 78 the lower edge 118 of the drum 94 will slip on the upper surface 120 of the spur gear 86.

Because of the above clutch effect of the drum 94 on the spur gear 86 and because of the presence of the pawl 100, the rotating member 78 will rotate in conjunction with the spur gear 86 when the spur gear 86 rotates clockwise as seen in FIG. 5 but will be held fixed by the pawl 100 when the spur gear 86 rotates counterclockwise as seen in FIG. 5. As was explained, the motor 76 is a reversing motor capable of rotating spur gear 86 both clockwise and counterclockwise. The rotating member 78 because of the presence of the pawl 100 is only free to rotate clockwise. However, the pinon 116 since it is fixed to the shaft 80 and thus fixed with respect to the spur gear 86, rotates both counterclockwise and clockwise in response to reversal of rotation of the motor 76.

The gear holding members 106, 108 and 110 serve as supports for a group of planetary gears which mesh with and are rotated by the pinon or sun gear 116. The first planetary gear, gear 122, is journaled in the gear holding member 106, close to the ratchet gear 98. A second planetary gear, gear 124 is spaced upwardly from the planetary gear 122 and is also journaled in the first gear holding member 106. In a simular manner the gear holding member 108 includes planetary gear 126 and planetary gear 128. And the gear holding member 110 includes planetary gear 130 and planetary gear 132. The planetary gears 122 through 132 are axially spaced from each other along the length of the pinon 116 and each of them mesh with and are therefore rotated by the pinon 116.

When the rotating member 78 rotates clockwise in conjunction with clockwise rotation of the spur gear 86, the planetary gears 122 to 132 orbit around the shaft 80 moving in conjunction with the pinon 116 but not rotating with respect to the pinon 116. When the spur gear 86 rotates counterclockwise and the rotating member 78 is fixed by the pawl 100, the pinon 116 since it is fixed to the shaft 80 and is independent of the rotating member 78, rotates counterclockwise. The rotation of pinon 116 rotates the planetary gears 122 through 132. As is evident from FIG. 5 each of the holding members 106, 108 and 110 include appropriate cutouts not separately identified or numbered in which the planetary gears 12 through 132 are located with these gears being positioned on appropriate axels also not separately identified or numbered within the cutouts.

FIG. 6 shows a sectional view through the rotating member 78 and the shaft 80. Further shown in FIG. 6 is a switch 134 having an upper switch contact 136 and a lower switch contact 138. The rotating member 78 is positioned in FIG. 6 such that the switch engagement member 96A has contacted the lower contact member 138 of switch 134 and pushed it upwardly until a circuit connection is made through the switch 134 via contact of the contacts 136 and 138. When rotating member 78 rotates through 45 degrees, the switch engagement member 96A no longer will be in the position shown in FIG. 6 and the lower contact 138 will descend breaking the circuit through the switch 134.

The switch 134 is a member of the bank of switches SW 1 through SW 8 which are shown in FIG. 7 and are supported by switch holding member 140. The switch holding member 140 is attached to the internal housing 82 in a location such that the switches SW 1 through SW 8 project over the surface of the rotating member 78 in positions to be contacted by the switch engagements 96A through H. Each of the switches SW 1 through SW 8 shown in FIG. 7 would include an upper and lower contact, 136 and 138 respectively, through which a circuit is made when contaced by the appropriate switch engagement member 96 located on the rotating member 78. The switches shown in FIG. 7 are the mechanical counterpart of the switches SW 1 through 8 shown in the switch bank 72 shown both in the schematic of FIG. 4 and the blocked diagram of FIG. 3.

The rotating member 78 in rotating clockwise as seen in FIG. 5 sequentially closes the switches SW 1 through SW 8 as it rotates in response to clockwise rotation of the rotating member 78. This in turn serves to interogate the switches SW 1 through SW 8 of the switch bank. The motor pinon 92 will rotate counterclockwise as seen in FIG. 5 to rotate the spur gear 86 clockwise. This will happen in response to a low signal being propogated from cpu through the drive 74 to the motor 76. As the rotating member 78 rotates clockwise in response to clockwise rotation of the spur gear 86, the switches SW 1 through SW 8 are interogated as they are closed in turn by the switch engagement members 96.

In response to an audio signal which is recognized by the CPU 68 as noted above, the CPU 68 sends a "high signal" to one of the switches SW 1 through SW 8. When the contacts 136 and 138 of the particular switch which is high close, a circuit is completed through the particular switch SW 1 through SW 8 which sends the high signal to the converter 74 which reverses the direction of rotation of the motor 76 such that the motor output pinon 92 as seen in FIG. 5 now rotates clockwise and the spur gear 86 rotates counterclockwise. In response to the counterclockwise rotation of the spur gear 86, the pawl 100 locks the rotating member 78 in position such that the rotating member 78 is fixed in this position and no longer rotates, and the appropriate switch SW 1 through SW 8 which is high is held in the closed position.

The spur gear 86, however, continues rotating counterclockwise which now rotates the pinon 116 counterclockwise. This in turn serves as a sun gear to rotate each of the individual planetary pinons 122 through 132. Motion can now be propagated from the planetary gears to the movable portions of the toy robot 30 as follows.

Figure 10:
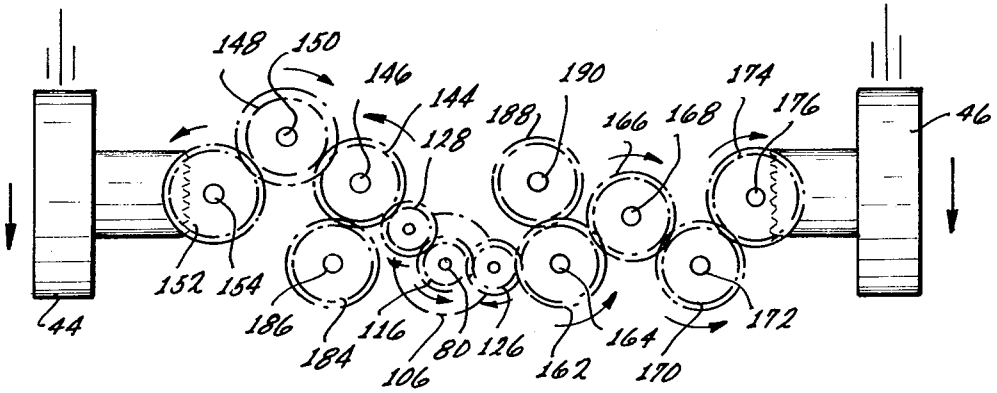
FIG. 10 is a top plan view of one of the gear trains of the invention showing a first spacial confirmation between components of this gear train.

Backward motion of the toy robot 30 is achieved via the gear train shown in FIG. 10. For these gears and other gears seen in FIGS. 8 through 16 unless otherwise noted the gears identified are all freely rotatably mounted on their appropriate axels and rotate independent of any other gear mounted on that axel.

The planetary gear 128 meshes with a spur gear 144 mounted on an axel 146. The spur gear 144 in turn meshes with a further spur ger 148 mounted on an axel 150. This in turn meshes with a spur gear 152 which is fixed to shaft 154. At the opposite end of axel 154 is a pinon 156 which is also fixed to the axel. The pinon 156 meshes with a crown gear 158 which is fixed to an axel 160. The axel 160 also has wheel 44 fixedly attached thereto. Thus ultimately rotation of the gear 116 is transferred via the planetary gear 128 to the wheel 44.

On the right hand side of the rotating member 78 as seen in FIG. 10 planetary gear 126 meshes with spur gear 162 which is mounted on axel 164. This in turn meshes with spur gear 166 which is mounted on axel 168. From there motion is propogated to spur gear 170 mounted on axel 172. Spur gear 174 which is fixed to shaft 176 meshes with spur gear 170. On the other end of shaft 176 is a pinon 178 which is also fixed to the shaft 176. The pinon 178 meshes with crown gear 180 which is fixed to axel 182 which also carries wheel 46.

Figure 11:
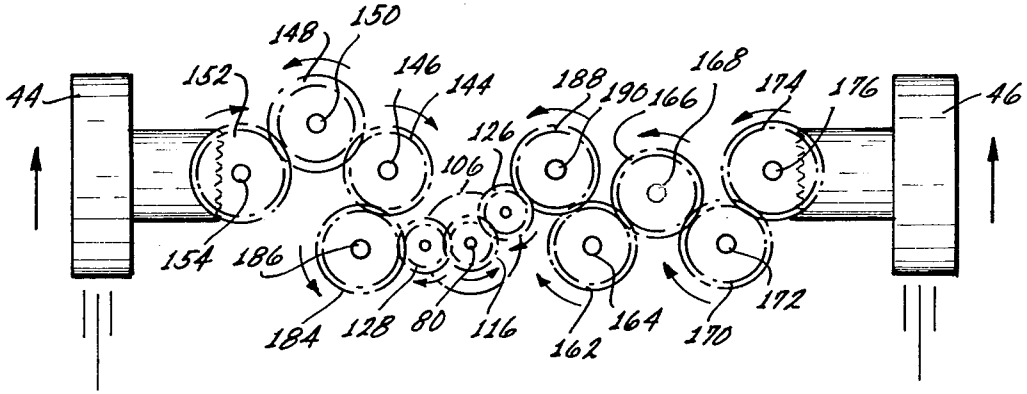
FIG. 11 is a top plan view similar to FIG. 8 except one of the components is shown in a further spacial confirmation.

When the rotating member 78 is positioned as is seen in FIG. 10, both the wheels 44 and 46 rotate in the same direction to move the toy robot 30 backward. When the rotating member 78 is positioned as seen in FIG. 11 both of the wheels 44 and 46 rotate in the same direction, but opposite to that in FIG. 10 to drive the toy robot 30 forward. Certain elements of the gear train seen in FIG. 10 are utilized for the forward motion except that the planetary gear 128 meshes with a spur gear 184 which is rotated on an axel 186. Spur gear 184 meshes with spur gear 144 and from there motion is propogated as was described for FIG. 10.

On the other side of the rotating member 78, that is the right hand side, the planetary gear 126 meshes with spur gear 188 which carried on axel 190. The spur gear 188 meshes with the spur gear 162 and from there motion is propogated to the wheel 46 as was described for FIG. 10. Since an extra gear, i.e. spur gear 184 on the left hand side and spur gear 188 on the right hand side, are interposed in the gear train of FIG. 11 compared to the gear train of FIG. 10, the motion of the wheel 44 and 46 is reversed between FIGS. 10 and 11.

Figure 12:
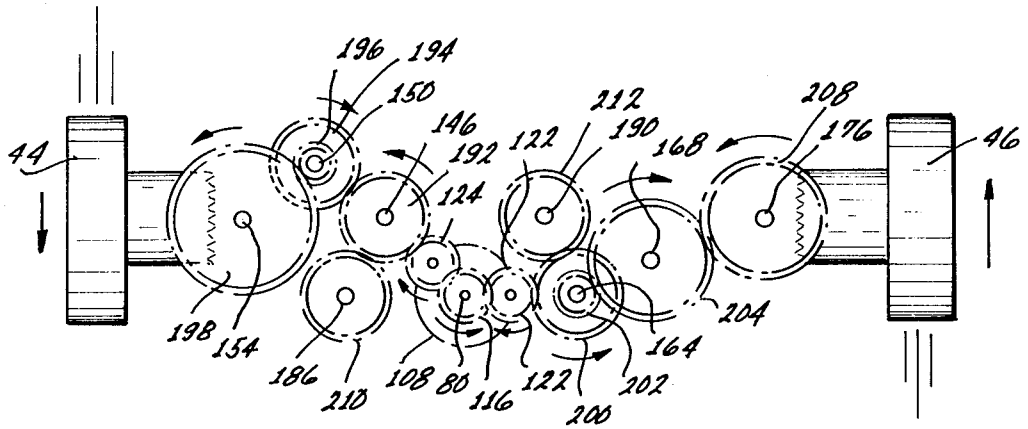
FIG. 12 is a top plan view of an additional gear train of the invention showing it in a first spacial configuration.
Figure 13:
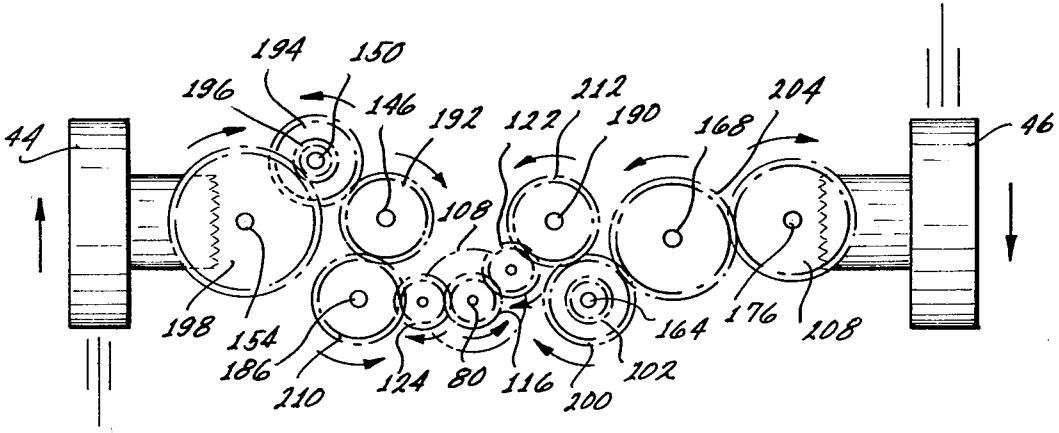
FIG. 13 is a top plan view similar to FIG. 12 except one of the components of the figure is shown in a further spacial configuration.

In FIGS. 12 and 13, the gear trains for a left hand turn and a right hand turn are shown. In FIG. 13 for a left hand turn, the rotating member 78 is positioned such that the planetary gears 122 and 124 located in the gear holding member 106 are brought into an appropriate mesh to form a gear train to the wheels 44 and 46. For a left hand turn, the planetary gear 124, meshes with spur gear 192 carried on axel 146. The spur gear 192 in turn meshes with spur gear 194 carried on axel 150. Integrally formed on spur gear 190 is a pinon 196 which rotates in conjunction with the spur gear 194. The pinon 196 meshes with spur gear 198 carried on shaft 154 to propogate motion to wheel 44.

On the right hand side of FIG. 12, the planetary gear 122 meshes with spur gear 200 carries on axel 164. Integrally formed with spur gear 200 so as to rotate in conjunction with it is pinon 202. Pinon 202 meshes with spur gear 204 carried on axel 168. The spur gear 204 is integrally formed with a pinon 206 The pinon 206 meshes with a spur gear 208 which is fixed to shaft 176 so as to rotate wheel 46.

For both the left turn described above and the right turn described below, there is a step down of gearing because of the transfer of motion through the spur gear 194 to the pinon 196 and the spur gear 204 to the pinon 206. Because of this, the drive wheels 44 and 46 of the toy robot 30 rotate at a slower speed during turns than when the toy robot 30 moves backward and forward.

For a right hand turn as seen in FIG. 13, a further gear is interspaced in the gear train both on the right hand and the left hand sides of the rotating member 78. On the left hand side of FIG. 13, the planetary gear 124 meshes with a spur gear 210 which s carried on axel 186. In turn the spur gear 210 meshes with the spur gear 192. Thus, an extra gear, gear 210, is introduced in the gear train between the planetary gear 124 and the gear 198 which drives the shaft 154. This causes the wheel 44 to rotate in the opposite direction compared to FIG. 12.

On the other side of the rotating member 78, in like manner, an additional gear is introduced. This is spur gear 212 which is mounted to axel 190. The spur gear 212 meshes with the spur gear 200. Motion is then propogated further via pinon 202 as per the left hand turn. But because of the extra gear 212, the wheel 46 rotates in the opposite direction from that seen in FIG. 12. Again, as with the left hand turn because there is a gear reduction, the wheels 44 and 46 rotate slower in making a right hand turn than they do in going forward or reverse.

Figure 14:
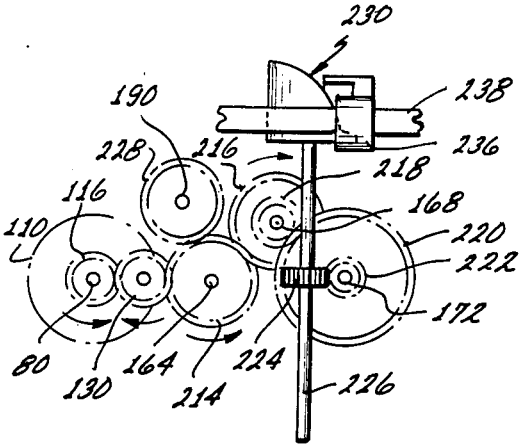
FIG. 14 is a top plan view of a gear train associated with one of the arms of the figurine seen in FIG. 1 with one of the components of FIG. 14 in a first spacial configuration.
Figure 15:
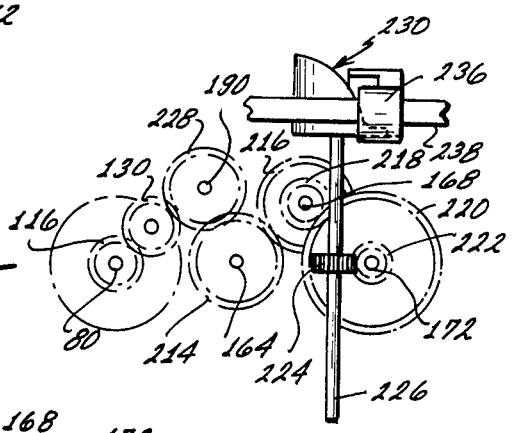
FIG. 15 is a top plan view similar to FIG. 14 except the component is in a different spacial configuration.
Figure 16:
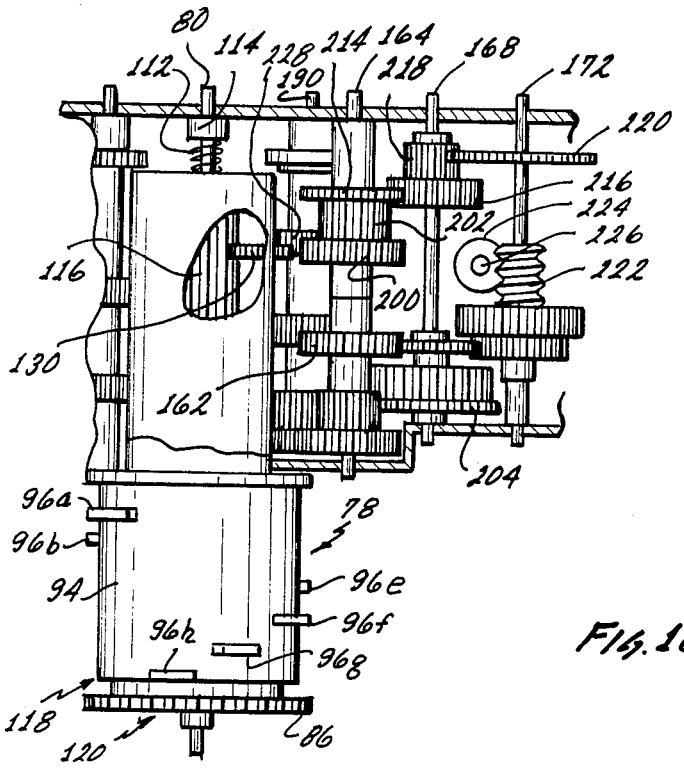
FIG. 16 is a rear elevational view similar to FIG. 8 and showing the gear train of FIG. 14.
Figure 18:
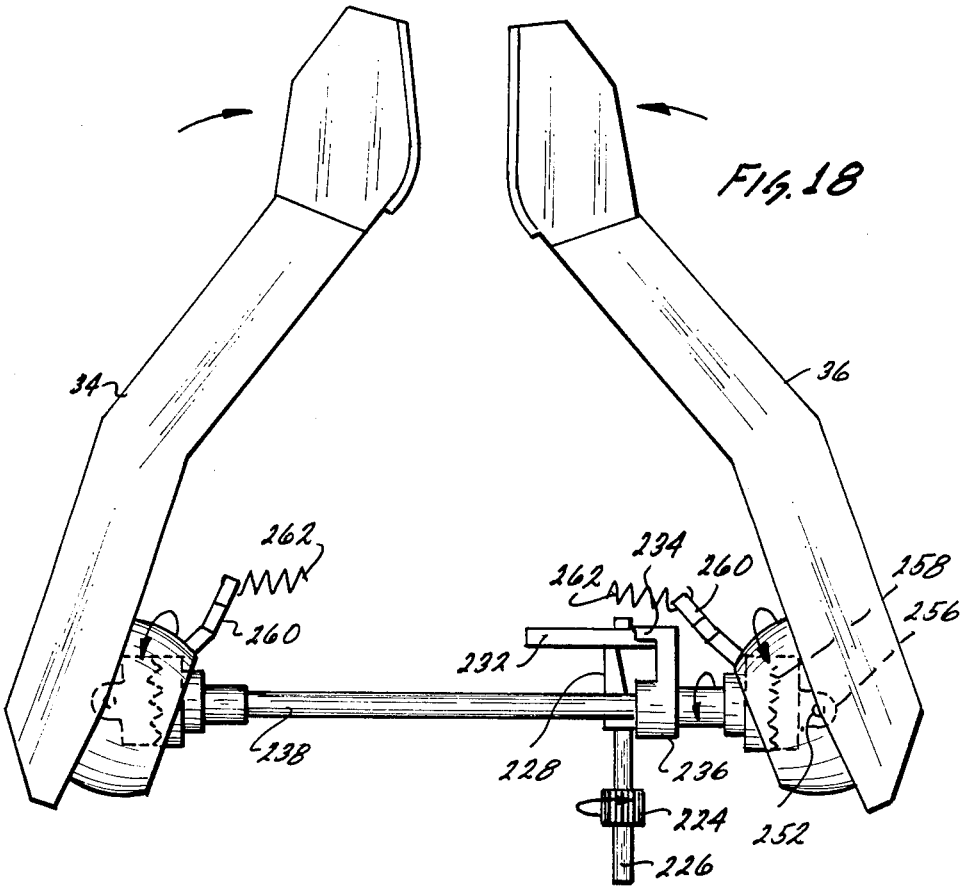
FIG. 18 is a top plan view similar to FIG. 17 except both of the arms of the device are shown and certain of the components are in a different spacial relationship than is seen in FIG. 17.
Figure 21:
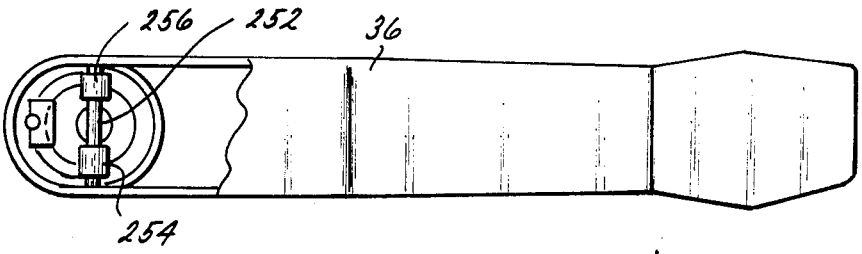
FIG. 21 is an elevational view partly in section of one of the arms of the figurine.

Referring now to FIGS. 14, 15, and 16, the gear train which drives the arms 34 and 36 is shown. The arms 34 and 36 are capable of moving upwardly from the position seen in FIG. 1 to an almost horizontal position. As they move upwardly, the ends or the hand portions of the arms, not separately identified or numbered, come in together in order to grasp objects. When the arms are moved down, the opposite is true. That is, the hands come apart from each other so as to release objects. The planetary gear 130 located in the third gear holding member 110 governs both the raising and the lowering of the arms. In FIG. 14 the planetary gear 130 meshes with spur gear 214 which is mounted on axel 164. Spur gear 214 meshes with spur gear 216 which is formed as an integral unit with pinon 218. Both of these are mounted about axel 168. A large spur gear 220 fixedly attached to axel 172 meshes with pinon 218. Also fixedly mounted to axel 172 is a worm gear 222. The worm gear 222 meshes with a pinon 224 which is fixed to a shaft 226.

Before describing motion from the shaft 226 to the arms 34 and 36, reference is made to FIG. 15 which is the gear train utilized to lower the arms 34 and 36 as shown. This gear train is the same as the gear train to raise them except it interspaces a new gear, spur gear 228, in between planetary gear 130 and spur gear 214. Spur gear 228 is mounted about axel 190. Because the gear train in FIG. 15 has an extra gear compared to the gear train of FIG. 14, the shaft 226 will rotate in the opposite direction for FIG. 15 as compared to FIG. 14.

Figure 19:
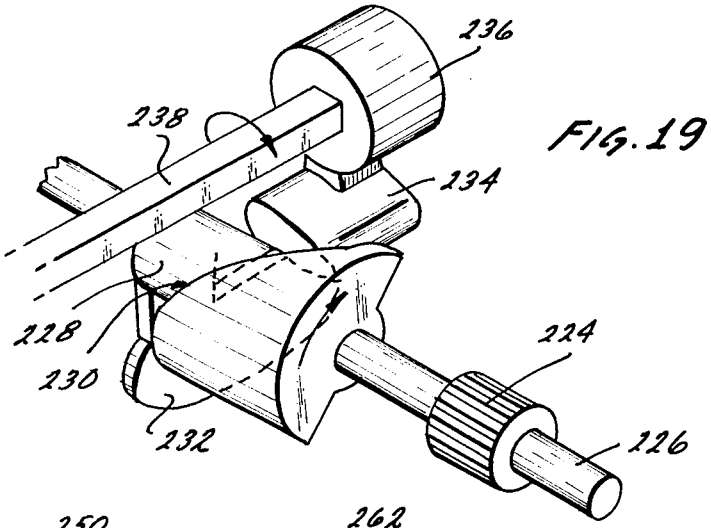
FIG. 19 is an isometric view of certain other components of FIG. 17.
Figure 17:
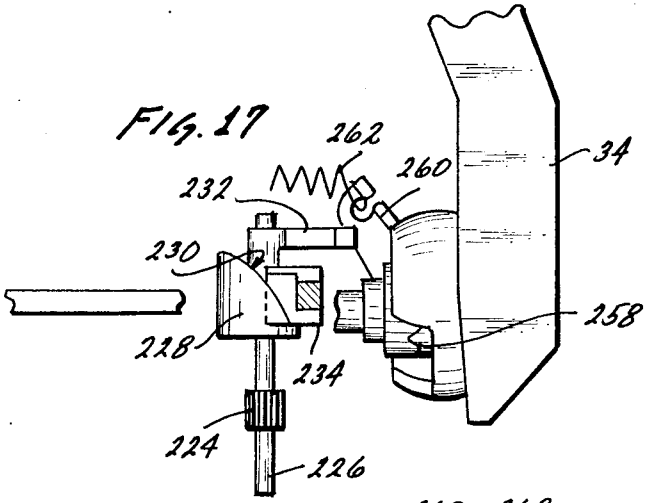
FIG. 17 is a top plan view showing attachment of the arms of the figurine to one of the components of FIG. 14.

In addition to FIGS. 14 through 16, reference is also made to FIGS. 17 through 21 for clarification of the arm movement. As seen in FIG. 19, on the end of shaft 226 is a member 228 which includes a helical surface 230. Also formed as a portion of member 228 is an extension 232. The extension 232 serves two functions. The first of these is, it governs the inward and outward movement of the hand portions of the arms 34 and 36 as the arms move up and down. And the second is, it contacts two electrical switches, the mechanical equivalent of the two switches shown in the electrical schematic, which are in series with SW 7 and SW 8.

As shaft 226 is rotated via the rotation of the pinon 224 attached to it, the helical cam surface 230 contacts cam follower 234 which is fixedly attached on a bushing 236 to a square shaft 238. The square shaft 238 in turn is ultimately connected to the arms 34 and 36 as hereinafter described. In any event, the helical cam surface 230 contacting the cam follower 234 translates the rotational motion of shaft 226 into rotational motion of shaft 238 which is perpendicular to the shaft 226.

Figure 20:
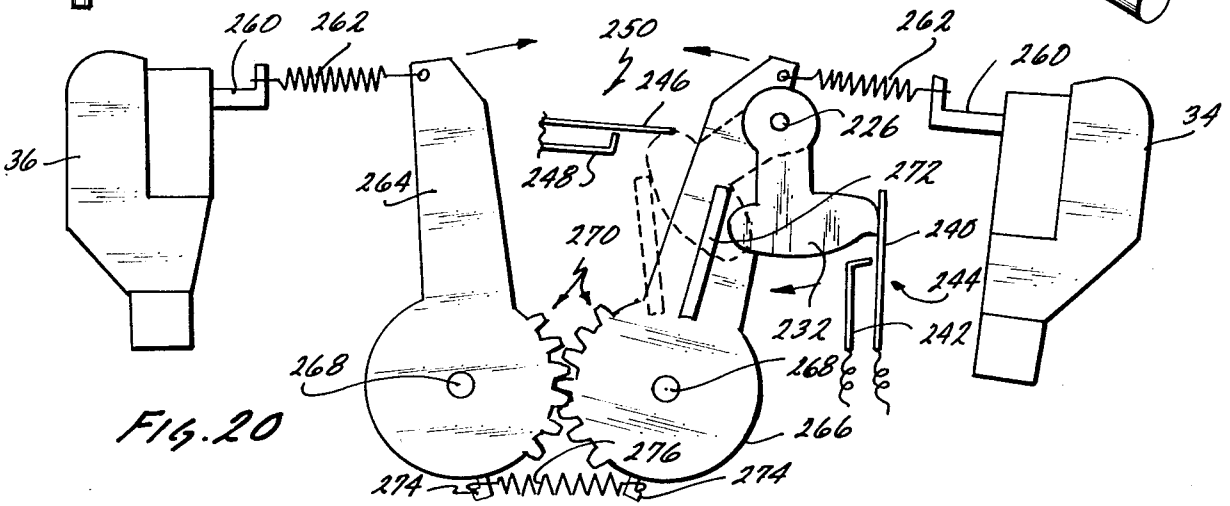
FIG. 20 is a front elevational view of further of the components associated with the arms of the figurine.

Referring now to FIG. 20, when the arms are in their lower most position, the extension 232 butts against and moves electrical contact 240 out of engagement with electrical contact 242 to break the circuit between them.

Together, the contacts 240 and 242 form a switch 244 which is in series with switch SW 8. Because of this, when the contacts 240 and 242 are opened, irrespective of the fact that the contacts of switch SW 8 are still closed, downward motion of the arms 34 and 36 stops. This positions the arms 34 and 36 at their lower most position as seen in FIG. 1.

When the arms 34 and 36 are moved upwardly because switch SW 7 is closed, afte rmoving an increment clockwise, the extension 232 releases from electrical contact 240, closing the switch 244. Thus, the next time the switch SW 8 is high simultaneously with closing of that switch, the arms 34 and 36 can again move downwardly.

The upward limit of movement of the arms 34 and 36 is governed as seen in phantom lines in FIG. 20 when the extension 232 contacts electrical contact 246, which together with electrical contact 248, forms switch 250. The switch 250 is in series with switch SW 7. As such, when the electrical contact 246 is moved upwardly and breakd contact with electrical contact 248, the switch 250 opens and irrespecitve of the fact that switch SW 7 is high and is still closed, upward movement of the arms 34 and 36 is halted. Upon initiation of downward movement of the arms, after the contact extension 232 has moved counterclockwise a few degrees, the electrical contact 246 once again contacts 248 to close switch 250 such that next time the switch SW 7 is high and is closed, the arms 34 and 36 can once again move upwardly.

Together the switches 244 and 250 govern the furthest downward extension of the arms 34 and 36 and the furthest upward extension of these arms respectively.

The arms 34 and 36 are attached to the respective ends of the square shaft 238 via pins collectively identified by the numberal 252 which fit into bearing surfaces collectively identified by the numeral 254 on the arms and bearing surfaces collectively identified by the numeral 256 formed on the end of clutch members 258 which attach to the end of the shaft 238. The clutch members 258 are formed as two piece re-entrant gears which are capable of sliding across one another such that the arms 34 and 36 can be positioned in multiple positions with respect the shaft 234.

Each of the arms include a small tab collectively identified by the numeral 260 which is connected via springs collectively identified by the numeral 262 to right and left side moving members 264 and 266 respectively. The moving members 264 and 266 pivotly connected via screws to the front side of the internal housing 82 by passing an appropriate screw through a central opening 268 formed in each of these members. The members 264 and 266 each include gear sectors collectively identified by the numeral 270 which are meshed together such that movement of one of the members 262 is transferred to other of the member 264.

On the inside surface of the member 266 is a small outwardly projecting wall 272 which is positioned so as to be contacted by the extension 232 as it moves frm switch 244 toward switch 250. In response to rotation of member 228, its extension 232 contacts the wall 272 rotating the moving member 266 and consequently also the moving member 264 through the gear sectors 270 such that the upper ends of the members 264 and 266 move toward each other tensing the springs 262. The springs 262 in turn pull in on the tabs 260 which causes the hand end of the arms 34 and 36 to come together. As the arms 34 and 36 are raised higher and higher, the hand end portions are brought closer together.

On the bottom of each of the members 264 and 266 is a small tab collectively identified by the numeral 274. A spring 276 stretches between the tabs 274. When the arms 34 and 36 are brought together in conjunction with their upward movement, the spring 276 is tensed. When the arms 34 and 36 are allowed to descend, as they move down, the extension 232 on member 228 is moved to the right in FIG. 20 allowing the spring 276 to pull against the tabs 274 releasing the tension on the springs 262 such that the ends of the arms 34 and 36 move outwardly so as to move away from each other in conjunction with the descent of the arms 34 and 36.

Refer now to FIGS. 2, 22 and 23, the mechanism for activation of eyes 40 and mouth 42 is shown. When SW 2 goes high and is closed, the third gear holding member 110 is positioned as is seen in FIG. 22, with the planetary gear 130 meshing with a spur gear 278 which is mounted on axel 186. A pinon 280 which is fixed to shaft 282 meshes with spur gear 278. The shaft 282 moves upwardly out of the internal housing 82 and includes a second pinon 284 also fixed to it. The pinon 284 has a cam 286 integrally formed with it. On top of the third gear holding member 10 is a small peg 288. The peg is approximately 180 degrees from the planetary gear 130.

The pinon 284 meshes with a large spur gear 290. On the underneath side of thes pur gear 290 is a convoluted cam surface 292 and an irregular ratchet gear 294. A mouth member 296 is pivotly mounted to the top of the housing 82 via an axel 298 and includes a rearwardly extending extension 300. The extension 300 is positioned so as to fit against the convoluted cam 292.

The mouth member 296 is biased under its own weight such that the extension 300 is held against the convoluted cam 292. In response to rotation of the spur gear 290, the extension 300 goes up and down against the surface of the cam which moves the mouth member 296 also upwardly and downwardly.

A small plastic spring 302 is positioned on the top of the internal housing 82 such that it contacts the irregular ratchet gear 294. As the cam 290 pins, the spring 302 is flipped from one tooth to the next making a sound. This sound is irregular because the ratchet gear 294 is irregular.

A first switch 304 having contact members as previously described for other switches, contacts the cam surface 286. As the cam surface 286 rotates, the switch 304 alternately opens and closes. The switch 304 is wired in series with a second switch 306 which is held in the closed position by the peg 288 when the rotating member 78 is positioned such that the planetary gear 130 meshes with the spur gear 278. Also in a series with switches 306 and 304 is an appropriate power supply and a light 308. The light 308 is placed behind the eyes 40 and the mouth member 296 such that as the cam 286 rotates, the switch 304 is alternately opened and closed to cause the light 308 to blink. The light 308 is only on when the switch SW 2 is closed. That is only when the planetary gear 130 is in position as seen in FIG. 22.

I claim:

1. A robot which comprises:

a housing;

a plurality of movable means movable mounted on said housing for movement relative to said housing;

a motor means for producing a first output and a second output mounted on said housing, one of said first and second outputs comprising a clockwise output and the other of said first and second outputs comprising a counterclockwise output;

a drive means for propagating motion, said drive means operatively associated with said motor means so as to receive both of said first and second outputs of said motor means;

said drive means further operatively associated with each of said plurality of movable means, said drive mans for transmitting said first output of said motor means independently to each of said movable means so as to move said movable means relative to said housing;

said drive means including selector means for transfering at least said first output, said selector means rotatably mounted on said housing, said selector means rotating in response to said second output and said selector means remaining stationary in one of a plurality of positions in response to said first output, in each of said positions said selector means transferrings aid first output to one of said plurality of movable means to move said respective movable means with respect to said housing;

a control means for controlling in which of said plurality of positions said selector means remains stationary, said control means operatively associated with said selector means;

said selector means includes a rotating member, said rotating member including a plurality of switch engagement means for engaging switches, said switch engagement means located on said rotating member in a spaced array;

said control means includes a plurality of switch means for switching, each of said switch means associated with one of said movable means, said switch means positioned in association with said rotating member whereby said array of said switch engagement means sequentially interacts with said plurality of switch means in response to rotation of said rotating member.

2. The robot of claim 1 wherein:

said control means includes an audio receiving means, said audio receiving means for receiving an audio input and in response to said audio inptu said control means moving said selector means between said plurality of positions.

3. The robot of claim 1 wherein:

said drive means further includes a clutch means operatively associated with said selector means, said first output transferred to said selector means by said clutch means.

4. The robot of claim 3 wherein:

said drive means further includes retaining means, said retaining means operatively associated with said selector means, said retaining means for interacting with said selector means to prevent rotation of said selector means in response to said first output.

5. The robot of claim 4 including:

at least one of said movable means comprises a rotating wheel capable of at least partially supporting said robot and propelling said robot in response to rotation of said selector means;

at least a further of said movable means comprising at least one grasping member, said grasping member for engaging and transporting an object.

6. The robor of claim 1 wherein:

at least one of said movable means comprises a rotating wheel capable of at least partially supporting said robot and propelling said robot in response to rotation of said selector means.

7. The robot of claim 6 wherein:

at least a further portion of said movable means comprises at least one grasping member, said grasping member for engaging and transporting an object.

8. The robot of claim 1 including:

electronic means associated with said switch means, said electronic means for activating said plurality of switch means one at a time in response to operator inputed stimulus.

9. The robot of claim 8 including:

said drive means further includes a clutch means operatively associated with said selector means, said first output transferred to said selector means by said clutch means;

said drive means further includes retaining means, said retaining means operatively associated with said selector means, said retaining means for interacting with said selector means to prevent rotation of said selector means in response to said first output.

10. The robot of claim 8 wherein:

said drive means further includes a plurality of gear train means, each of said plurality of movable means associated with one of said gear train means;

said rotating member includes a plurality of gear train means selecting means, each of said gear train means selecting means associated with one of said plurality of said switch means whereby in response to activation of said switch means by said electronic means motion is propogated through the respective gear train means selecting means to the associated gear train means and to the respective movable means.

11. A voice actuated toy which comprises:

an electronic means for receiving audio signals and storing records of said audio signals, said electornic means further for comparing an inputed audio signal with eah of its previously stored audio signals, said electronic means outputting one of a plurality of output signals in response to recept of an input audio signal which amtches one of said stored records of aduio signals;

a plurality of switches connected to said electornic means, the number of said switches equal to the number of said stored records of said auido signals, each of said switches including an output terminal;

a drive means operatively associated with said switches, said drive means having a plurality of movable members each of which is capable of executing a predetermined movement, said drive means movable member executing said movements in response to said output signals of said electronic means;

said drive means further including switch selector means for interacting with said plurality of switches one at a time, each of said respective output signals from said electronic means propogated to said drive means only when the respective switch associated with said respective signal is activated by said switch selector means.

12. A voice toy of claim 11 wherein:

said electronic means includes digitizing means for digitizing said audio signals received;

said electronic means further including central processing means and memory means associated with said central processing means, said central processing means for processing said digitized signal and initially storing a record of said signal in said memory means and further in comparing further digitized signals with said records in said memory means so as to match said further digitized signals with said records in said memory means, said central processing means outputting one of said output signals in response to matching of said further digitized signals with one of said records.

13. The toy of claim 12 wherein:

said signal outputed by said central processing means is one of a high or a low signal to said respective switches means;

said drive means including motor means and said electronic means further including motor control means, said motor control means for reversing the output of said motor betwen one of a clockwise and counterclockwise output in response to a receipt of one of said outputted signals from said central processing means.

14. The toy of claim 11 wherein:

said electronic mean sincludes a sound recognition means, said sound recognition means for receiving and storing a plurality of vocal commands, said sound recognition means for further comparing a vocal command to said plurality of stored vocal commands and in response to a match thereof said electronic means outputting one of said plurality of output signals.

15. The toy of claim 11 wherein:

said drive means includes a motor means mounted on said housing, said motor means producing a first output and a second output, one of said first and second outputs comprising a clockwise output and the other of said first and second outputs comprising a counterclockwise output;

said drive means further independently transmitting said first output of said motor means to each of said mvoble members so as to move said movable members relative to said housing;

said switch selector means rotatably mounted on said housing, said selector means rotating in response to said second output and said selector means remaining stationary in one of a plurality of positions in response to said first output, in each of said positions said selector means transferring said first output ot one of said plurality of movable members to move said respective movable members with respect to said housing.

16. The toy of claim 15 wherein:

said electronic means includes a soudn recognition means, said sound recognition means for receiving and storing a plurality of records of vocal commands, said sound recognition means for further comparing a voacl command to said plurality of stored records of vocal commands and in response to a match thereof said electronic means outputting one of said plurality of output signals.

17. The toy of claim 16 wherein:

said sound recognition means includes digitizing means for digitizing said audio signals received;

said sound recognition means further including central processing means and memory means associated with said central processing, said central processing means for processing said digitized signal and initially storing a record of said signal in said memory means and further in comparing further digitized signals with said records in said memory means so as to match said further digitized signals with said records in said memory means, said central processing means outputting one said output signals in response to said match.

18. A sound recognition toy which comprises:

a housing;

an electronic sound recognition means, said sound recognition means for receiving and storing a plurality of records of audio commands, said sound recognition means for further comparing a new audio command to said plurality of stored records of audio commands and in response to a match between said new audio command and one of said stored records of audio commands said sound recognition means outputting an output signal;

a plurality of switches connected to said sound recognition means, the number of said switches equla to the number of said stored records of audio commands, each of said switches including an output terminal;

a motor means for producing an output, said motor means located on said housing;

a selector means for selecting a switch, said selector means operatively associated with said motor means, said selector means rotatably mounted on said housing, said selector means including a switch engagement means for activating said switches one at a time, said switch engagement means positioned in association with said plurality of switches;

a plurality of movable means for producing movement, said movble means mounted on said housing so as to move relative to said housing, said plurality of movable means operatively associated with said selector means so as to be capable of being activated by said selector means in response to activating of one of said switches and when so activated said movable means operatively connectable to said motor means so as to be moved by said motor means.

* * * * *

UNITED STATES PATENT AND TRADEMARK OFFICE

CERTIFICATE OF CORRECTION

PATENT NO. : 4,717,364

DATED : JANUARY 5, 1988

INVENTOR(S) : MASAMI FURUKAWA

It is certified that error appears in the above-identified patent and that said Letters Patent is hereby corrected as shown below:

Column 1, line 10, "operation" should be --operator--.

Column 1, line 45, "poliferation should be --proliferation--.

Column 1, line 64, insert a --,-- after "children".

Column 2, line 27, "in an" should be --an--.

Column 2, lines 51 and 52, "movable" should be --movably--.

Column 3, line 20; and Column 10, lines 18 and 19, "interogate" should be --interrogate--.

Column 6, line 58; Column 7, line 41; and Column 10, line 26, "interogated" should be --interrogated--.

Column 3, line 21; Column 3, lines 35 and 36; Column 6, line 59; Column 6, line 61; Column 7, line 17; Column 7, lines 19 and 20; Column 7, line 55; Abstract, line 13; and Abstract, line 15, "interogation" should be --interrogation--.

UNITED STATES PATENT AND TRADEMARK OFFICE

CERTIFICATE OF CORRECTION

PATENT NO. : 4,717,364

DATED : JANUARY 5, 1988

INVENTOR(S) : MASAMI FURUKAWA

It is certified that error appears in the above-identified patent and that said Letters Patent is hereby corrected as shown below:

Column 7, line 26; Column 7, line 44; Column 7, line 52; Column 7, line 60; Column 7, lines 66 and 67; Abstract, line 11; and Abstract, line 15, "interogator" should be --interrogator--.

In the Abstract, line 11, "interogating" should be --interrogating--.

Column 4, line 6; Column 4, line 9; column 4, line 12; Column 4, line 16; Column 4, line 19; Column 4, line 22; and Column 4, line 30, "spacial" should be --spatial--.

Column 6, line 3, insert --is-- between "signal" and "then".

Column 6, line 4, "MN15541NTR" should be --MN1541NTR--.

Column 6, line 45, "and" , second occurrence, should be -- are --.

Column 6, line 53, delete "images".

Column 8, line 62, "with" should be --in--.

Column 9, line 50, "12" should be --122--.

Column 10, line 9, "contaced" should be --contacted--.

UNITED STATES PATENT AND TRADEMARK OFFICE

CERTIFICATE OF CORRECTION

PATENT NO. : 4,717,364

DATED : JANUARY 5, 1988

INVENTOR(S) : MASAMI FURUKAWA

It is certified that error appears in the above-identified patent and that said Letters Patent is hereby corrected as shown below:

Column 8, line 61 (twice); Column 8, line 66; Column 8, line 17; Column 9, line 18; Column 9, line 25; Column 9, line 41; Column 9, line 42; Column 9, line 44; Column 9, line 46; Column 10, line 20; Column 10, line 38; Column 10, line 47; Column 10, line 64(twice); Column 11, line 8; Column 11, line 9; Column 11, line 42; Column 11, line 43; Column 11, line 49(twice); Column 11, line 51(twice); Column 12, line 7; Column 12, line 28; Column 12, line 30; Column 12, line 32; Column 14, line 20; Column 14, line 23(twice); and Column 14, line 28, "pinon" should be --pinion--.

Column 8, line 4; Column 9, line 52; and Column 10, line 57, "axels" should be --axles--.

UNITED STATES PATENT AND TRADEMARK OFFICE

CERTIFICATE OF CORRECTION

PATENT NO. : 4,717,364

DATED : JANUARY 5, 1988

INVENTOR(S) : MASAMI FURUKAWA

It is certified that error appears in the above-identified patent and that said Letters Patent is hereby corrected as shown below:

Column 10, line 58; Column 10, line 60; Column 10, line 61; Column 10, line 63; Column 10, line 64; Column 10, line 65; Column 10, line 66; Column 11, line 3; Column 11, line 4; Column 11, line 6; Column 11, line 10; Column 11, line 20; Column 11, line 25; Column 11, line 40; Column 11, line 41; Column 11, line 47; Column 11, line 50; Column 11, line 65; Column 12, line 5; Column 12, line 26; Column 12, line 29; Column 12, line 30; Column 12, line 31; Column 12, line 40; Column 14, line 20; and Column 14, line 32, "axel" should be --axle--.

Column 10, line 61, "ger" should be --gear--.

Column 11, line 51, insert a --.-- between "206" and "The".

Column 13, line 9, "afte rmoving" should be --after moving--.

Column 13, line 21, "breakd" should be --breaks--.

Column 13, line 22, "irrespecitve" should be --irrespective--.

Column 13, line 36, "numberal" should be --numeral--.

Column 13, line 44, insert --to-- between "respect" and "the".

UNITED STATES PATENT AND TRADEMARK OFFICE

CERTIFICATE OF CORRECTION

PATENT NO. : 4,717,364

DATED : JANUARY 5, 1988

INVENTOR(S) : MASAMI FURUKAWA

It is certified that error appears in the above-identified patent and that said Letters Patent is hereby corrected as shown below:

Column 13, line 50, "connected" should be --connects--.

Column 13, line 60, "frm" should be --from--.

Column 14, line 25, "10" should be --110--.

Column 14, line 29, "thes pur" should be --the spur--.

Column 14, line 43, "pins" should be --spins--.

Column 14, line 65, "movable" , second occurrence, should be -- movebly --.

Column 15, line 10, "mans" should be --means--.

Column 15, line 21, "transferrings aid" should be --transferring said--.

Column 15, line 45, "inptu" should be --input--.

Column 15, line 68, "robor" should be --robot--.

Column 16, line 41, "electornic" should be --electronic--.

Column 16, line 43, "eah" should be --each--.

Column 16, line 45, "recept" should be --receipt--.

Column 16, line 46, "amtches" should be --matches--.

Column 16, line 47, "aduio" should be --audio--.

UNITED STATES PATENT AND TRADEMARK OFFICE

CERTIFICATE OF CORRECTION

PATENT NO. : 4,717,364

DATED : JANUARY 5, 1988

INVENTOR(S) : MASAMI FURUKAWA

It is certified that error appears in the above-identified patent and that said Letters Patent is hereby corrected as shown below:

Column 16, line 50,"auido" should be --audio--.

Column 16, line 66, insert --actuated-- between "voice" and "toy".

Column 17, line 20, "betwen" should be --between--.

Column 17, line 25, "mean sincludes" should be --means includes--.

Column 17, line 42, "mvoble" should be --movable--.

Column 17, line 50, "ot" should be --to--.

Column 17, line 54, "soudn" should be --sound--.

Column 18, line 2, "voacl" should be --vocal--.

Column 18, line 32, "equla" should be --equal--.

Column 18, line 47, "movble" should be --movable--.

In the Abstract, line 11, "cycicly" should be --cyclically--.

Signed and Sealed this

Ninth Day of May, 1989

*Attest:*

*Attesting Officer*

DONALD J. QUIGG

*Commissioner of Patents and Trademarks*